United States Patent [19]

Clark

[11] Patent Number: 4,512,054

[45] Date of Patent: Apr. 23, 1985

[54] BACK-SCRUBBER DEVICE

[76] Inventor: Henry S. Clark, 1510 13th St. West, Bradenton, Fla. 33505

[21] Appl. No.: 599,009

[22] Filed: Apr. 11, 1984

[51] Int. Cl.[3] ..... A47K 7/03

[52] U.S. Cl. ..... 15/222; 15/210 R; 128/63

[58] Field of Search ..... 15/222, 208, 104.94, 15/209 R, 210 R; 128/62 R, 63; D28/63

[56] References Cited

U.S. PATENT DOCUMENTS

| | | | |
|---|---|---|---|
| 1,334,716 | 3/1920 | Shont | 15/208 X |
| 1,367,747 | 2/1921 | Keplinger | 128/63 X |
| 2,008,990 | 7/1935 | Mullen | 128/63 X |
| 2,363,697 | 11/1944 | Schirmer | 15/222 X |
| 2,754,533 | 7/1956 | Swartout | 15/222 |
| 3,072,946 | 1/1963 | La Falce | 15/222 |
| 4,187,575 | 2/1980 | Collins | 128/63 X |
| 4,422,205 | 12/1983 | Braxter | 15/222 |

*Primary Examiner*—Chris K. Moore

*Attorney, Agent, or Firm*—Mason, Fenwick & Lawrence

[57] ABSTRACT

A back scrubber formed of terry cloth comprises a generally wider central scrubber section from which transverse open-ended pleats extend alternatingly from opposite sides; elongated hand grasp members extend from opposite ends of the central scrubber section and are also formed of terry cloth. The open-ended pleats receive air on their interior so as to be easily dried and avoid mildew. Both the hand grasp members and the central scrubber section are formed of a folded over and stitched double thickness cloth construction.

20 Claims, 7 Drawing Figures

BACK-SCRUBBER DEVICE

BACKGROUND OF THE INVENTION

The present invention is in the field of personal cleansing devices and is specifically directed to a new and improved means for scrubbing and cleaning a person's back.

A number of prior devices such as brushes on long handles have been proposed for cleaning the back. Also, it has been proposed in U.S. Pat. No. 4,422,205 to provide an elongated cloth member having pockets for foam rubber or the like to provide a bulbous construction for cleaning the back. Unfortunately, devices of the aforementioned type are relatively expensive to fabricate and also suffer from the shortcoming of retaining substantial moisture so as to require frequent cleaning in order to avoid becoming odorous and unpleasant to use. The inclusion of the foam rubber or the like elements in such devices renders them much slower to dry and therefore susceptible to mildew then would otherwise be the case.

U.S. Pat. No. 3,959,841 illustrates another type of device employing an insert for positioning in a pocket for applying lotions, creams or the like to the body when the device is contacted with the body. Here again, the device requires separation of the constituents to permit cleaning following usage of the device.

SUMMARY OF THE INVENTION

It is the object of the present invention to provide a new and improved back scrubber device.

It is a further object of the invention to provide a new and improved back scrubber device that is economical to fabricate.

Yet another object of the present invention is the provision of a new and improved back scrubber device that is easy to clean following usage.

A further object of the present invention is the provision of a new and improved back scrubber device that can be quickly dried to remove all moisture from the device.

Achievement of the foregoing objects is enabled by the preferred embodiment of the present invention through the provision of an elongated back scrubber formed of terry cloth or other suitable material. The back scrubber comprises a central scrubber section consisting of a double thickness of terry cloth and first and second hand grasp members extending outwardly from opposite ends thereof. The scrubber section is provided with a unique arrangement of transverse pleats which alternately extend outwardly therefrom on opposite sides of the scrubber section. In use, the hand grasp members are held in opposite hands of the user and the device is applied to the back of the user and reciprocated for effecting a thorough scrubbing action. Use of the alternate pleats permits the device to be oriented in either one direction or the other without any impairment of the function of the device. Also, the pleats are open at each end to permit receipt of air internally so as to be easily dried following usage of the device.

A better understanding of the preferred embodiment of the invention will be achieved when the following detailed description is read in conjunction with the appended drawings in which like reference numerals are used for the same parts as illustrated in the different drawing figures.

DESCRIPTION OF THE PREFERRED EMBODIMENT

Figures 1, 2A, 2B, 2C, 2D, 2E, 3:
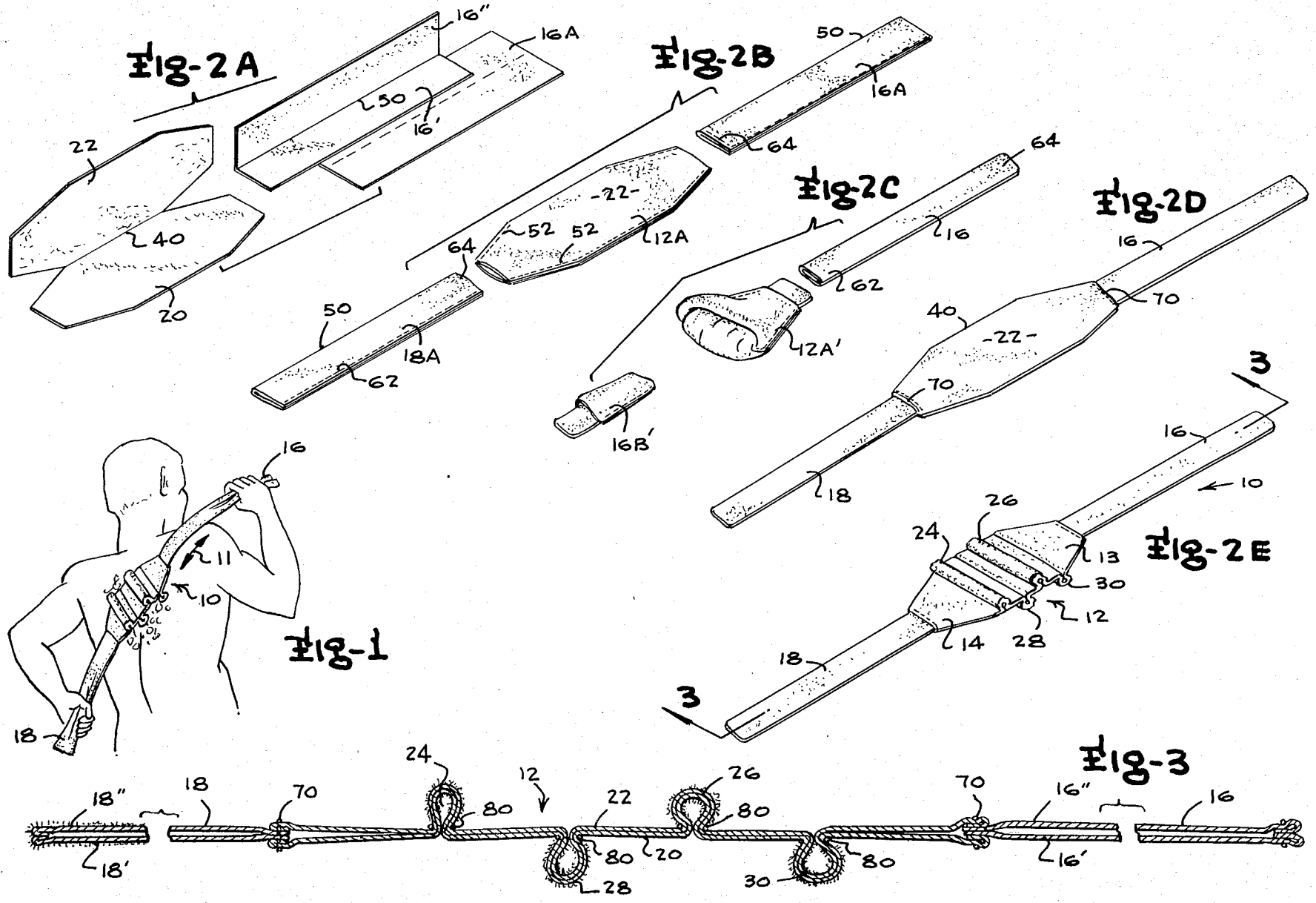
FIG. 1 is a perspective view illustrating usage of the preferred embodiment of the invention for scrubbing a user's back.
FIG. 2A is an exploded perspective view illustrating the initial step in fabrication of the preferred embodiment.
FIG. 2B is an exploded perspective view illustrating a subsequent step in the fabrication of the preferred embodiment.
FIG. 2C is an exploded perspective view illustrating a subsequent step in the fabrication of the preferred embodiment.
FIG. 2D is a perspective view illustrating the nearly completed device prior to the provision of pleats on the scrubber section.
FIG. 2E is a perspective view of the preferred embodiment.
FIG. 3 is a sectional view taken along lines 3—3 of FIG. 2E.

The preferred embodiment of the invention, generally designated 10, is shown in use in FIG. 1 and comprises an elongated member formed of terry cloth or the like and which is employed for scrubbing the back in a reciprocating manner as shown in FIG. 1.

More specifically, the preferred embodiment of the invention comprises a wider central scrubber section 12 having first and second ends 13 and 14. A more narrow first hand grasp member 16 extends outwardly from the first end 13 of the central scrubber section 12 and a second identical hand grasp member 18 similarly extends outwardly from the second end of the central scrubber section 12. It should be observed that the hand grasp members 16 and 18 are formed of a double thickness of cloth. More specifically, the first hand grasp member is formed of a lower panel 16' and an upper panel 16" and the second hand grasp member is similarly formed of lower and upper panels 18' and 18" respectively.

The central scrubber section 12 is also formed of a double thickness of terry cloth and consists of a lower panel 20 and an upper panel 22. Upper pleats 24 and 26 are provided to extend transversely across the central scrubber section 12 and similarly lower pleats 28 and 30 extend downwardly therefrom. It should be noted that the upper pleats and the lower pleats alternate and the central scrubber member can be positioned with either panel 20 or panel 22 facing the back of the user for usage. It should also be noted that the central scrubber section 12 is wider in its central portion than the hand grasp members 16 and 18 but has tapering end portions tapering into the juncture with the hand grasp members as best shown in FIG. 2D.

Fabrication of the preferred embodiment is easily achieved by providing joined panels 20 and 22 for the central scrubber member 12 as shown in FIG. 2A with the panels being connected along a fold line 40. The hand grasp members are similarly formed from a single sheet 16A which is folded along fold line 50. The opposite hand grasp member 18 is not illustrated in FIG. 2A; however, it should be understood that it is similarly folded in the same manner as hand grasp member 16.

After the constituents are folded into their final position, stitching 52 is provided along the front and rear edges of the central scrubber section to provide the partially completed scrubber section 12A as shown in FIG. 2B. Similarly, stitching 62 is provided along the forward edges of partially completed hand grasp members 16A and 18A as shown in FIG. 2B with the end portions of these members being closed by stitching 64. The hand grasp members are then pulled (turned) through their central openings so as to reverse the orientation of the parts as shown by hand grasp member 18B' to provide completed hand grasp members 16 and 18 as shown in FIG. 2D. Similarly, the central scrubber section 12 is also reversed as shown by 12A' in FIG. 2C. The hand grasp members are then stitched inside the open tapered end portions of the central scrubber section by stitching 70 as shown in FIG. 2D.

Fabrication of the preferred embodiment is completed by the application of transverse stitches 80 on opposite sides of the central scrubber section to provide the alternating transverse open-ended pleats 24, 26, 28 and 30. In use, the hand grasp members 16 and 18 are held in the different hands of the user as shown in FIG. 1 and the device is reciprocated in the manner indicated by arrows 11. The device can be easily reversed and positioning is consequently irrelevant since the operation is always the same.

After usage, the device is easily rinsed to remove all traces of soap and any other materials such as particles of skin or the like. Since the pleats 12 are open-ended, air can flow to the interior of the pleats and the device can be easily dried for subsequent storage and is not susceptible to mildew.

It should be understood that a preferred embodiment of the invention has been disclosed. While those of skill in the art will undoubtedly conceive of modifications of the preferred embodiment, it should be further understood that the spirit and scope of the invention is to be limited solely by the appended claims.

I claim:

1. A back scrubber comprising:

an elongated cloth member including a central scrubber section and first and second outer hand grasp members respectively extending outwardly from opposite ends of said central scrubber section and wherein said central scrubber section includes transverse pleats alternately extending outwardly therefrom on opposite sides thereof.

2. A back scrubber as recited in claim 1 wherein said central scrubber section comprises first and second outer panels.

3. A back scrubber as recited in claim 2 wherein said first and second hand grasp members each comprise a double thickness cloth member.

4. A back scrubber as recited in claim 3 wherein said central scrubber section and said hand grasp members are formed of terry cloth.

5. A back scrubber as recited in claim 1 wherein said central scrubber section and said hand grasp members are formed of terry cloth.

6. A back scrubber as recited in claim 5 wherein said central scrubber section comprises first and second outer panels.

7. A back scrubber as recited in claim 1 wherein said central scrubber section is substantially wider at its central portion than said hand grasp members.

8. A back scrubber as recited in claim 7 wherein said central scrubber section comprises first and second outer panels.

9. A back scrubber as recited in claim 8 wherein said first and second hand grasp members each comprise a double thickness cloth member.

10. A back scrubber as recited in claim 9 wherein said central scrubber section and said hand grasp members are formed of terry cloth.

11. A back scrubber as recited in claim 7 wherein said central scrubber section has first and second tapered end portions respectively connected to said first and second hand grasp members.

12. A back scrubber as recited in claim 11 wherein said central scrubber section comprises first and second outer panels.

13. A back scrubber as recited in claim 12 wherein said first and second hand grasp members each comprise a double thickness cloth member.

14. A back scrubber as recited in claim 13 wherein said central scrubber section and said hand grasp members are formed of terry cloth.

15. A back scrubber as recited in claim 1 wherein said pleats are open-ended.

16. A back scrubber as recited in claim 15 wherein said central scrubber section comprises first and second outer panels.

17. A back scrubber as recited in claim 16 wherein said first and second hand grasp members each comprise a double thickness cloth member.

18. A back scrubber as recited in claim 17 wherein said central scrubber section and said hand grasp members are formed of terry cloth.

19. A back scrubber as recited in claim 18 wherein said central scrubber section is substantially wider at its central portion than said hand grasp members.

20. A back scrubber as recited in claim 19 wherein said central scrubber section has first and second tapered end portions respectively connected to said first and second hand grasp members.

* * * * *